US010443333B2

(12) United States Patent
Grimsbo et al.

(10) Patent No.: US 10,443,333 B2
(45) Date of Patent: Oct. 15, 2019

(54) METHOD FOR REMOVING IRON-CONTAINING CASING FROM A WELL BORE

(71) Applicant: STATOIL PETROLEUM AS, Stavanger (NO)

(72) Inventors: Gjermund Grimsbo, Trondheim (NO); Marcus Fathi, Stavanger (NO); Torgeir Wenn, Stavanger (NO); Pål Viggo Hemmingsen, Trondheim (NO); Astrid Bjørgum, Trondheim (NO)

(73) Assignee: STATOIL PETROLEUM AS, Stavanger (NO)

( * ) Notice: Subject to any disclaimer, the term of this patent is extended or adjusted under 35 U.S.C. 154(b) by 195 days.

(21) Appl. No.: 15/513,048

(22) PCT Filed: Sep. 17, 2015

(86) PCT No.: PCT/NO2015/050165
§ 371 (c)(1),
(2) Date: Mar. 21, 2017

(87) PCT Pub. No.: WO2016/048157
PCT Pub. Date: Mar. 31, 2016

(65) Prior Publication Data

US 2017/0241225 A1 Aug. 24, 2017

(30) Foreign Application Priority Data

Sep. 22, 2014 (GB) ..... 1416675.5

(51) Int. Cl.
*E21B 29/02* (2006.01)
*E21B 33/12* (2006.01)
(Continued)

(52) U.S. Cl.
CPC ..... *E21B 29/02* (2013.01); *E21B 33/12* (2013.01); *E21B 33/13* (2013.01); *E21B 47/00* (2013.01)

(58) Field of Classification Search
CPC ..... E21B 29/02; E21B 29/002
See application file for complete search history.

(56) References Cited

U.S. PATENT DOCUMENTS 2,152,306 A * 3/1939 Grebe ..... C09K 8/528 166/376
2,261,292 A * 11/1941 Salniko ..... E21B 29/02 166/291
(Continued)

FOREIGN PATENT DOCUMENTS

RU 2227201 C2 4/2004
RU 2 370 625 C1 10/2009
(Continued)

OTHER PUBLICATIONS

Combined Search and Examination Report for application No. GB1416675.5 dated Dec. 24, 2014.
(Continued)

*Primary Examiner* — William D Hutton, Jr.
*Assistant Examiner* — Steven A MacDonald
(74) *Attorney, Agent, or Firm* — Birch, Stewart, Kolasch & Birch, LLP

(57) ABSTRACT

There is provided a method for removing iron-containing casing from a well bore comprising providing a cathode in said well bore, wherein said cathode is connected to the negative pole of a power source; connecting said iron-containing casing to the positive pole of said power source; injecting an electrolyte into said well bore, wherein said electrolyte contacts said iron-containing casing and said cathode; applying a current so that the iron in said iron-containing casing is oxidised to iron cations; allowing said
(Continued)

iron cations to dissolve in said electrolyte; and removing said electrolyte from said well bore. Also provided are a system for removing iron-containing casing from a well bore, a method for monitoring the removal of an iron-containing casing from a well bore and a method for plugging and abandoning a well.

31 Claims, 5 Drawing Sheets

(51) Int. Cl.
*E21B 33/13* (2006.01)
*E21B 47/00* (2012.01)

(56) References Cited

U.S. PATENT DOCUMENTS 2,283,563 A * 5/1942 Lyons ..... E21B 29/02 166/376
3,489,211 A * 1/1970 Kammerer, Jr. ..... E21B 4/18 166/301
4,071,278 A * 1/1978 Carpenter ..... E21B 43/2401 166/248
4,144,936 A 3/1979 Evans
4,652,054 A * 3/1987 Copenhafer ..... B01D 61/44 204/534
4,887,668 A * 12/1989 Lynde ..... B23B 5/16 166/55.8
2009/0014177 A1* 1/2009 Hilleary ..... E21B 33/14 166/285
2009/0184056 A1 7/2009 Smith et al.
2012/0061096 A1 3/2012 Jensen et al.
2013/0105159 A1 5/2013 Alvarez et al.
2013/0248185 A1* 9/2013 Parsche ..... E21B 36/04 166/302
2015/0247818 A1* 9/2015 Silvester ..... G01N 27/4045 205/793

FOREIGN PATENT DOCUMENTS

RU 2 396 416 C1 8/2010
WO WO 2014/060949 A2 4/2014

OTHER PUBLICATIONS

Combined Search and Examination Report for application No. GB1616383.4 dated Feb. 3, 2017.
Examination Report for application No. GB1416675.5 dated Jan. 30, 2017.
International Search Report for PCT/NO2015/050166 (PCT/ISA/210) dated Dec. 3, 2015.
International Search Report, issued in PCT/NO2015/050165 (PCT/ISA/210), dated Dec. 3, 2015.
Search Report for Application No. GB 1515127.7 dated Mar. 17, 2016.
Written Opinion of the International Searching Authority for PCT/NO2015/050166 (PCT/ISA/237) dated Dec. 3, 2015.
Written Opinion of the International Searching Authority, issued in PCT/NO2015/050165 (PCT/ISA/237), dated Dec. 3, 2015.

* cited by examiner

Figure 5

| Electrochemical testing, 500 mm casing tube | Test performed, date | Time | Current applied | Voltage | Current density | Dissolved Fe, from weight loss | | Theoretical dissolved Fe | | Current efficiency | Reduced steel pipe thickness | Time to dissolve casing 9 5/8 " x 8 1/2 " in size |
|---|---|---|---|---|---|---|---|---|---|---|---|---|
| | | [d] | [A] | [V] | [A/m²] | [g] | [mol] | [mol] | [g] | [%] | [mm/d] | [d] |
| **3.5w% NaCl, added HCl (RT)** | 03.09.2013 | 0.063 | 12.9 | 4 – 2.8 | 108 | 27 | 0.48 | 0.59 | 33 | **82** | 0.46 | **31** |
| pH 3 at start | | | | | | | | | | | | |
| pH 9.6 at end | | | | | | | | | | | | |
| **3.5w% NaCl, added HCl (60 °C)** | 04.09.2013 | 0.208 | 21 | 2.3 – 2.0 | 175 | 116 | **2.08** | 1.96 | 109 | **106** | 0.59 | **24** |
| pH 3.2 at start | | | | | | | | | | | | |
| pH 8.2 at end | | | | | | | | | | | | |
| **3.5wt% NaCl (60 °C)** | 05.09.2013 | 0.208 | 42 | 4.0 | 350 | 227 | **4.06** | 3.92 | 219 | **104** | 1.1 | **12** |
| No HCl added | | | | | | | | | | | | |
| **3.5wt% NaCl, added HCl (60 °C)** | 06.09.2013 | 0.215 | 42 | 4.0 | 350 | 231 | **4.13** | 4.04 | 226 | **102** | 1.1 | **13** |
| pH 2 at start | | | | | | | | | | | | |
| pH 7 at end | | | | | | | | | | | | |
| **3.5wt% NaCl + 20% $H_2SO_4$ (60 °C)** | 11.09.2013 | 0.167 | 42 | 5.0 | 350 | 167 | **2.99** | 3.13 | 175 | **95** | 1.1 | **14** |
| **3.5wt% NaCl + 20% $H_2SO_4$ (60 °C)** | 12.09.2013 | 0.167 | 42 | 5 | 350 | 171 | **3.06** | 3 | 175 | **98** | 1.1 | **13** |
| **3.5wt% NaCl + 20% $H_2SO_4$ (60 °C)** | 13.09.2013 | 0.167 | 42 | | 700 | 185 | **3.31** | 3.13 | 175 | **106** | 2.3 | **6** |
| NB: 250 mm casing tube | | | | | | | | | | | | |

Figure 6

| Electrochemical testing, 60 °C 250 mm casing tube | Density of the electrolyte (g/cm2) | Time | Current applied | Voltage | Current density | Dissolved Fe, weight loss data | | | Theoretical dissolved Fe | | Current efficiency | Reduced steel pipe thickness | Time to dissolve casing 9 5/8 " x 8 1/2 " in size |
|---|---|---|---|---|---|---|---|---|---|---|---|---|---|
| | | [d] | [A] | [V] | [A/m2] | [g] | [mol] | [g/l] | [mol] | [g] | [%] | [mm/d] | [d] |
| 20wt% NaCl (no acid) | 1.11 | 1.00 | 42.00 | 2.0 | 700 | 1051 | **19** | 53 | 19 | 1051 | **100** | 2.2 | **6** |
| 20wt% NaCl (no acid) | 1.11 | 0.25 | 42.00 | 2.0 | 700 | 256 | **4.6** | 13 | 4.7 | 263 | **97** | 2.2 | **7** |
| 20wt% NaCl + 20% H2SO4 | 1.28 | 0.29 | 42.00 | 2.0 | 700 | 305 | **5.5** | 15 | 5.5 | 307 | **99** | 2.2 | **6** |
| 20wt% NaCl + 20% H2SO4 | 1.28 | 0.25 | 51.50 | 1.2 | 858 | 325 | **5.8** | 32 | 5.8 | 628 | **101** | 2.7 | **5** |
| 20wt% NaCl + 20% H2SO4 | 1.28 | 1.00 | 54.00 | 1 - 1.7 | 900 | 1357 | **24** | 68 | 24 | 1351 | **100** | 2.9 | **5** |
| 3.5wt% NaCl + 20% H2SO4 | 1.19 | 1.00 | 54.10 | 1 - 1.5 | 902 | 1352 | **24** | 68 | 24 | 1354 | **100** | 2.9 | **5** |
| 3.5wt% NaCl + 20% H2SO4 | 1.10 | 1.03 | 42.00 | 2 - 5.5 | 700 | 955 | **17** | 1151 | 19 | 1079 | **89** | 2.0 | **7** |

1: Same electrolyte in two following tests

Figure 7

| Electrochemical testing, 60 °C Alternating current 250 mm casing tube | Density of the electrolyte | Time | Current applied | Voltage | Current density | Dissolved Fe, weight loss data | | | Theoretical dissolved Fe | | Assumed current | Reduced steel pipe thickness | Time to dissolve casing 9 5/8 " x 8 1/2 " in size |
|---|---|---|---|---|---|---|---|---|---|---|---|---|---|
| | [g/cm2] | [d] | [A] | [V] | [A/m2] | [g] | [mol] | [g/l] | [mol] | [g] | [%] | [mm/d] | [d] |
| 20wt% NaCl + 20% $H_2SO_4$ | 1.19 | 0.27 | | | | 209 | 3.7 | 20[1] | | | | 1.6 | 9 |
| Electrochemical | | 0.11 | 54.1 | 2 | 902 | | | | 2.6 | 147 | 100 | | |
| Chemical | | 0.16 | | | | | | | | 62 | | | |
| 20wt% NaCl + 20% $H_2SO_4$ | 1.19 | 0.99 | | | | 691 | 12.4 | 55[2] | | | | 1.5 | 10 |
| Electrochemical | | 0.50 | 54.1 | 2 | 902 | | | | 11 | 639 | 10 | | |
| Chemical | | 0.49 | | | | | | | | 52 | | | |

[1]: Electrolyte used in one earlier test

[2]: Same electrolyte as above

METHOD FOR REMOVING IRON-CONTAINING CASING FROM A WELL BORE

FIELD OF THE INVENTION

The present invention relates to methods of removing iron-containing (e.g. steel) casing from a well bore, e.g. as part of a plugging and abandonment procedure. The method is electrochemical. The present invention also relates to systems for removing iron-containing (e.g. steel) casing from a well bore.

BACKGROUND

Wells used in gas and oil recovery need to be satisfactorily plugged and sealed after the wells have reached their end-of life and it is not economically feasible to keep the wells in service. Plugging of wells is performed in connection with permanent abandonment of wells due to decommissioning of fields or in connection with permanent abandonment of a section of a well to construct a new well bore (known as side tracking or slot recovery) with a new geological well target.

A well is constructed by a hole being drilled down into the reservoir using a drilling rig and then sections of steel pipe, referred to as liner or casing, are placed in the hole to provide mechanical, structural and hydraulic integrity to the well bore. Cement is placed between the outside of the liner and the bore hole and then tubing is inserted into the liner to connect the well bore to the surface.

Once the reservoir has been abandoned, a permanent well barrier must be established across the full cross-section of the well. This is generally achieved by removal of the inner tubing from the well bore by means of a workover rig which pulls the tubing to the surface. The liner, or at least portions of the liner, is also typically removed by a rig which essentially mills it out.

Well barriers, usually called plugs, are then established across the full cross-section of the well. Typically the plugs are formed with cement. This isolates the reservoir(s) and prevents flow of formation fluids between reservoirs or to the surface. It is often necessary to remove the inner tubing and liner from the wellbore in order to set the cement plug against the formation and thereby avoid any leaks. This is the case whenever there were problems in setting the cement in the first place and/or if there are doubts about the quality of the cement sheath.

Improperly abandoned wells are a serious liability so it is important to ensure that the well is properly plugged and sealed. However, the number of steps and equipment involved, such as a rig, results in this stage being costly and time-consuming, at a time when the well no longer generates revenue. Significantly the deployment of the rig in the abandonment operation means it cannot be utilised in the preparation of a new well or well bore.

SUMMARY OF INVENTION

Thus viewed from a first aspect the present invention provides a method for removing iron-containing casing from a well bore comprising:

(i) providing a cathode in said well bore, wherein said cathode is connected to the negative pole of a power source;

(ii) connecting said iron-containing casing to the positive pole of said power source;

(iii) injecting an electrolyte into said well bore, wherein said electrolyte contacts said iron-containing casing and said cathode;

(iv) applying a current so that the iron in said iron-containing casing is oxidised to iron cations;

(v) allowing said iron cations to dissolve in said electrolyte; and (vi) removing said electrolyte from said well bore.

Viewed from a further aspect the present invention provides a system for removing iron-containing casing from a well bore comprising:

(i) a well bore comprising a cathode connected to the negative pole of a power source and an iron-containing casing connected to the positive pole of the power source;

(ii) a power source;

(iii) a first fluid line for injecting an electrolyte into said well bore;

(iv) a means for removing electrolyte from said well bore;

(v) a tank comprising said electrolyte;

wherein said tank is fluidly connected to said first fluid line.

Viewed from a further aspect the present invention provides a method for monitoring the removal of an iron-containing casing from a well bore comprising:

(i) carrying out an electrochemical method for removing iron-containing casing from a well bore wherein $H_2$ gas is liberated in the process, e.g. a method as hereinbefore defined;

(ii) determining the amount of hydrogen liberated in the process; and (iii) determining the amount of iron-containing casing dissolved.

Viewed from a further aspect the present invention provides a method of plugging and abandoning a well comprising;

(i) carrying out a method for removing iron-containing casing from a well bore as hereinbefore defined.

Definitions

As used herein the term "well bore" refers to a hole in the formation that forms the actual well. The well bore may have any orientation, e.g. vertical, horizontal or any angle in between vertical and horizontal. In the present case the well bore comprises a liner.

As used herein the term "casing" refers to any oil country tubular goods (OCTGs) including pipe, casing, liner and tubing. As described above a casing, e.g. a liner, is placed in the well bore after drilling to improve the structural integrity of the well. The well bore is located in the interior of the liner. Typically piping and tubing are located in the interior of the liner.

As used herein the terms "plugs" and "plugged" refer to barriers, or to the presence of barriers respectively, in a well bore. The purpose of plugs is to prevent the flow of formation fluids from the reservoir to the surface.

As used herein the term "interval" refers to a length of well bore.

As used herein the term "electrochemical" refers to a chemical reaction, or group of chemical reactions, that require external electrical power or a voltage supply to occur. The electrical power or voltage supply forms part of a complete electrical circuit comprising the chemical reaction(s). In preferred electrochemical reactions employed in the present invention the liner is utilised as one electrode.

DESCRIPTION OF INVENTION

The present invention provides a method for removing iron-containing (e.g. steel) casing from a well bore. It comprises:

(i) providing a cathode in said well bore, wherein the cathode is connected to the negative pole of a power source;

(ii) connecting the iron-containing casing to the positive pole of the power source;

(iii) injecting an electrolyte into the well bore, wherein the electrolyte contacts the iron-containing casing and the cathode;

(iv) applying a current so that the iron in the iron-containing casing is oxidised to iron cations;

(v) allowing the iron cations to dissolve in the electrolyte; and (vi) removing the electrolyte from the well bore.

In preferred methods of the invention the iron-containing casing is removed from a selected interval of the well bore. Thus advantageously the methods of the invention are selective. This means that selected or targetted lengths of casing may be removed whilst other parts of the casing is left in place. This is beneficial because the well bore can be permanently plugged across the full cross section of the well bore in the interval from which the casing has been removed, whilst minimising the cost of casing removal. A preferred selected interval is 0.5 to 200 m in length, more preferably 10 to 150 m in length and still more preferably 20 to 100 m in length. The selected interval is preferably located in the cap rock above a hydrocarbon depleted reservoir. Preferably the well bore and/or the selected interval is located offshore.

In preferred methods of the invention the exterior surface of a fluid line for injecting electrolyte into the well bore forms the cathode. Preferably the exterior surface of the fluid line is metallic. Representative examples of suitable metals include iron, e.g. steel. Preferably the cathode, and still more preferably the fluid line having an exterior surface forming the cathode, is centrally located in the well bore.

In some preferred methods of the invention the well bore is temporarily plugged above and temporarily or permanently plugged below the selected interval of the well bore prior to the injection of electrolyte. Temporary and permanent plugging may be carried out according to conventional procedures known in the art and using any conventional material which is resistant to electrolyte. The purpose of the plugs is to prevent the electrolyte from contacting areas of the casing which are to remain in the well bore.

In other preferred methods of the invention the well bore is not temporarily or permanently plugged. In such methods the treatment of a selected interval of the well bore is preferably achieved by the location of the cathode. More preferably the exterior surface of a fluid line is partially electrically conducting (i.e. cathodic) and partially insulated. In other words the exterior surface of a fluid line is patterned so that it functions as a cathode in certain areas and as an insulator in other areas. In such methods the fluid line is preferably made of a metallic material but is partially coated with a non-metallic material, i.e. in those areas where it is to be insulating.

In some preferred methods of the invention, and particularly when plugs are employed in the well bore, the electrolyte is delivered into, and removed from, the well bore via a dual fluid line. Still more preferably the electrolyte is delivered into the well bore near the bottom of the selected interval of the well bore. Yet more preferably the electrolyte is removed from the well bore near the top of the selected interval of the well bore. Thus preferably the fluid line delivering electrolyte into the well bore is longer that the fluid line removing electrolyte from the well bore. Alternatively, however, the electrolyte may be delivered into the well bore near the top of the selected interval of the well bore and the electrolyte removed from the well bore near the bottom of the selected interval of the well bore.

In other preferred methods of the invention, particularly when a fluid line having an exterior surface which is partially electrically conducting and partially insulating is used, the electrolyte is delivered into the well bore via a first fluid line. Preferably the electrolyte is delivered into the well bore near the bottom of the selected interval of the well bore. In this method, the electrolyte is preferably removed from the well bore via the well bore. This is feasible because the electrolyte will not cause any significant damage to the casing in the absence of electrical current, i.e. it only induces significant oxidation in those areas where a cathode is provided.

The electrolyte may be injected into the well bore using conventional equipment and apparatus. Preferably the electrolyte has a superficial linear velocity of 2 to 50 cm/s in the well bore and more preferably 5 to 25 cm/s in the well bore. The provision of the electrolyte at relatively high velocities increases the rate of removal of the casing by mechanically breaking and fragmenting chemically weakened casing as well as reducing the concentration of dissolved iron near the surface which may otherwise slow down the rate of its dissolution.

The electrolyte may be any fluid that is electrically conducting. Preferably the electrolyte comprises at least 2 wt % salt and more preferably at least 3% wt salt. The maximum level of salt in the electrolyte may be 30% wt. Typical salts present in the electrolyte include NaCl, KCl and $CaCl_2$). NaCl is particularly preferred. An example of a suitable electrolyte is sea water.

Preferred electrolytes for use in the methods of the present invention further comprises an iron cation stabilising compound. Suitable compounds include strong acids, for example, hydrochloric acid, sulfuric acid, nitric acid, hydrobromic acid, hydroiodic acid, perchloric acid and mixtures thereof. Hydrochloric acid and sulfuric acid are particularly preferred acids. The electrolyte preferably comprises 2 to 30% acid, more preferably 5 to 25 wt % acid and still more preferably 10 to 25% wt acid. Preferably the electrolyte has a pH of <5, more preferably <1 and still more preferably <0, for example a pH between −3 and 1.

One particularly preferred electrolyte comprises HCl and NaCl. Another particularly preferred electrolyte consists essentially of (e.g. consists of) $H_2SO_4$.

The purpose of the electrolyte is to complete the electrical circuit that facilitates the dissolution of iron present in the iron-containing casing by electrolysis. The application of current causes oxidation of the iron to $Fe^{2+}$ in the casing. The $Fe^{2+}$ ions react with $O_2$ or water to produce $Fe^{3+}$ or $Fe(OH)_2$ respectively. The electrons react with $H^+$, either from water or from acid present in the electrolyte, at the cathode to produce hydrogen gas.

In preferred methods of the invention the electrical current density applied is 50 to 2000 ampere/$m^2$ casing surface, more preferably 75 to 1500 ampere/$m^2$ casing surface and still more preferably 100 to 1000 ampere/$m^2$ casing surface. Preferably the voltage is in the range 1 to 10 V and more preferably 2 to 5 V. Preferably the power supplied is 5 to 500 kW and more preferably 10 to 400 kW, for removal of a 100 m section of casing.

As in the method based on an acidic solution described above, the method of the invention removes at least a portion of the iron-containing casing by ultimately causing it to dissolve into solution. This process significantly weakens the remaining casing, particularly as electrolyte contacts the casing at relatively high velocity. Fragments or particles of casing may therefore detach from the main body of the casing. Ideally these fragments or particles are removed from the well bore in the electrolyte.

Preferably therefore the electrolyte further comprises a density modifying compound. Density modifying compounds include soluble salts and insoluble salts. Representative examples of suitable soluble salts include NaCl, KCl and $CaCl_2$). Representative examples of suitable solids include barite (e.g. barium sulphate) particles. Preferably the electrolyte comprises 0 to 30% wt density modifying compounds.

Preferred methods of the invention further comprise reinjecting the electrolyte removed from the well bore into the well bore. This is advantageous as a typical casing will require treatment with relatively large volumes of electrolyte to be completely removed. Recycling or recirculating the electrolyte therefore enables significant cost savings to be made. In preferred methods of the invention 20 to 200 $m^3$ and more preferably 50 to 150 $m^3$ of electrolyte is in circulation.

Preferred methods of the invention further comprise removing the dissolved iron ions, e.g. iron compounds, from the electrolyte prior to reinjecting the electrolyte into the well bore. Suitable methods for removing iron ions (e.g. iron compounds) include precipitation and filtration and electrolysis. It is desirable to remove iron ions (e.g. iron compounds) from the electrolyte to avoid the electrolyte reaching the saturation limit for the ions.

Further preferred methods of the invention further comprise removing hydrogen from the electrolyte prior to reinjecting the electrolyte into the well bore. Conventional liquid/gas separation apparatus may be used. The hydrogen is collected, preferably monitored and measured, and sent to flare.

In still further preferred methods iron ions (e.g. iron compounds) and hydrogen are removed from the electrolyte prior to reinjecting the electrolyte into the well bore. In this case the iron ions (e.g. iron compounds) may be removed either prior to, or after, the hydrogen. Thus preferred methods of the invention further comprise the steps of:

(i) removing the dissolved iron ions (e.g. iron compounds) from the electrolyte removed from the well bore;
(ii) removing hydrogen from the electrolyte removed from the well bore; and
(iii) reinjecting the electrolyte into the well bore.

The present invention also provides a further system for removing iron-containing casing from a well bore. The system comprises:

(i) a well bore comprising a cathode connected to the negative pole of a power source and an iron-containing casing connected to the positive pole of the power source;
(ii) a power source;
(iii) a first fluid line for injecting an electrolyte into the well bore;
(iv) a means for removing electrolyte from the well bore;
(v) a tank comprising the electrolyte;
wherein said tank is fluidly connected to the first fluid line.

In a preferred system of the invention the cathode is the exterior surface of the first fluid line. In a further preferred system the cathode is centrally located in the well bore.

In one preferred system of the invention, the exterior surface of the first fluid line is partially electrically conducting and partially insulated. Preferably the exterior surface of the first fluid line is partially insulated by a coating of non-metallic material. In such systems, the means for removing electrolyte from the well bore is preferably the well bore.

Another preferred system of the invention, comprises a second fluid line. Still more preferably the first and second fluid lines are present in a dual fluid line. The well bore of such systems preferably comprises temporary plugs above and temporary or permanent plugs below the interval from which the iron-containing casing is to be removed.

Further preferred systems of the invention further comprise:

(vi) a separation system for separating iron ions (e.g. iron compounds) and/or hydrogen from the electrolyte,
wherein the means for removing electrolyte is fluidly connected to the separation system; and
the separation system is fluidly connected to the tank.

In preferred systems the first fluid line terminates near the bottom of the interval from which the iron-containing casing is to be removed. In further preferred systems the means for removing electrolyte terminates near the top of the interval from which the iron-containing casing is to be removed. Preferably the electrolyte is as hereinbefore defined.

In preferred systems the tank and, when present, the separation system is located on a floating vessel. Preferably the separation system comprises a means for monitoring and/or measuring the amount of hydrogen removed from the electrolyte.

The present invention further provides a method for monitoring the removal of an iron-containing casing from a well bore comprising:

(i) carrying out an electrochemical method for removing iron-containing casing from a well bore according to the present invention wherein $H_2$ gas is liberated in the process;
(ii) determining the amount of hydrogen liberated in the process; and
(iii) determining the amount of iron-containing casing dissolved.

Approximately 18 kMol of hydrogen gas is generated per ton of casing, e.g. steel casing, dissolved. This is about 420 $m^3$ at atmospheric conditions. A 100 m section of 9⅝' casing comprises 8 tons of steel and therefore produces a total of about 3400 $m^3$ of hydrogen. Preferably the hydrogen is removed from the solution in a gas/liquid separator and then processed to flare at a safe location. The amount of hydrogen present in the solution returned from the well bore is preferably monitored and/or measured and used to determined how much steel has been dissolved and therefore how much steel still needs to be dissolved at any given point in time.

The present invention also provides a method of plugging and abandoning a well comprising;

(i) carrying out a method as hereinbefore defined; and
(ii) optionally sealing the well.

In preferred methods the well is a depleted hydrocarbon well.

BRIEF DESCRIPTION OF THE FIGURES

FIG. 5 is a table showing the results of preliminary electrochemical dissolution testing in different test solutions at 60° C. and 0.1 m/s.

FIG. 6 is a table showing the results of electrochemical dissolution testing in 20 wt % NaCl and 20 wt % NaCl+20% $H_2SO_4$ at 60° C. and 0.1 m/s.

FIG. 7 is a table showing the results of combined electrochemical and chemical dissolution in 20 wt % NaCl+20% $H_2SO_4$ at 60° C. and 0.1 m/s.

DETAILED DESCRIPTION OF INVENTION

Figure 1:
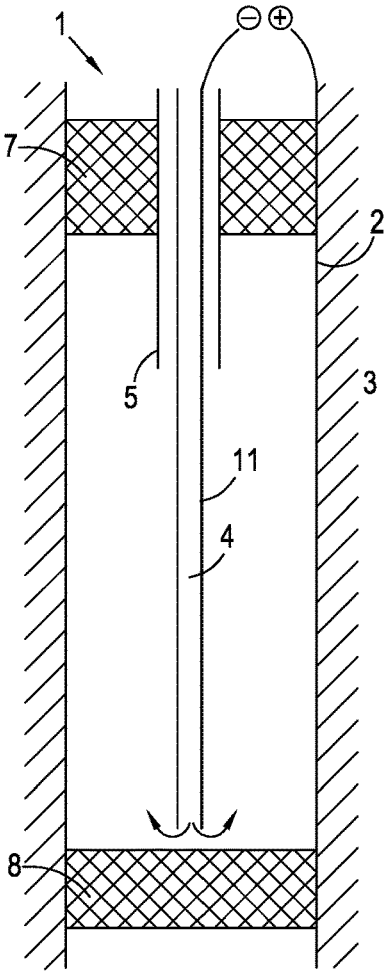
FIG. 1 is a schematic of a part of a system for carrying out a preferred electrochemical method of the invention for removing iron-containing casing from a well.

FIG. 1 shows a system and method for removing an iron-containing (e.g. steel) casing 2 from a well 1. The casing 2 is fixed in the formation by cement 3 and the interior of the casing 2 forms the well bore. The system comprises a first fluid line 4 and a second fluid line 5 in the form of a dual fluid line. The first fluid line 4 is connected to a tank 6 on the surface (not shown). The well bore also comprises temporary plugs 7, 8 which are located at the top and bottom of the interval from which the iron-containing casing, e.g. steel is to be removed.

In FIG. 1, the iron-containing casing 2, which is electrically conductive, is connected to the positive pole of a power source 10. The negative pole of the power source 10 is connected to the exterior surface of first fluid line 4 which is electrically conducting. This forms the cathode 11. Advantageously the first fluid line 4 and therefore the cathode is 11 is located centrally within the well bore.

In methods of the invention, an electrolyte, typically sea water, is injected into the well bore from a tank 6 (not shown) via the first fluid line 4. Preferably the electrolyte has a superficial linear velocity of 2 to 50 cm/s in the well bore. Power is applied via power source 10. Preferably the electrical current density is 100 to 1000 ampere/$m^2$ casing surface and the voltage is 2 to 5 v. For a 100 m interval the total electrical power supply is therefore 7000-70,000 ampere which corresponds to a power requirement of about 14 to 350 kW.

The current causes oxidation of the anode, i.e. the iron-containing casing 2 and reduction of the cathode, i.e. the exterior surface of the first fluid line 4. The $Fe^{2+}$ cations formed by oxidation of the casing dissolve in the electrolyte. The hydrogen formed by reduction is also present in the electrolyte. The electrolyte is preferably removed via the second fluid line 5. Preferably the electrolyte is continuously recirculated through the first and second fluid lines until the iron-containing (e.g. steel) casing is completely removed. The time taken to remove casing is typically about 5-6 days per 100 m of casing. Preferably the volume of electrolyte circulating in the system is 50 to 150 $m^3$.

Figure 2:
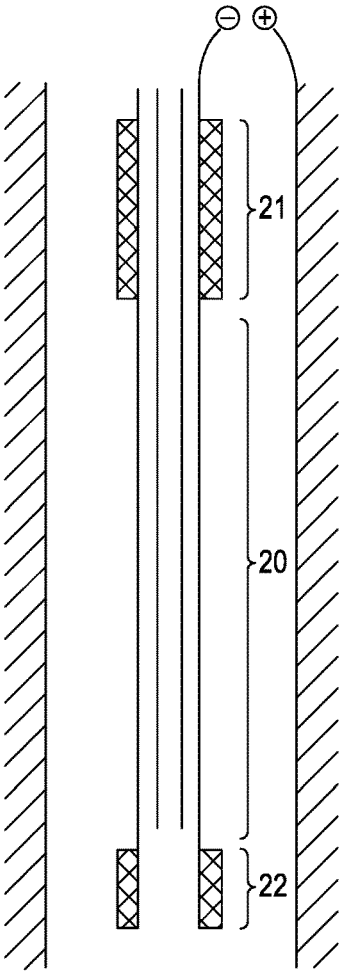
FIG. 2 is a schematic of a part of a system for carrying out an alternative preferred electrochemical method of the invention for removing iron-containing casing from a well.

FIG. 2 shows an alternative system and method for removing an iron-containing (e.g. steel) casing 2 from a well 1. As in FIG. 1 the casing 2 is fixed in the formation by cement 3 and the interior of the casing 2 forms the well bore. Additionally, as in FIG. 1, the casing 2, which is electrically conducting, is connected to the positive pole of a power source 10.

Also as in FIG. 1, the system comprises a first fluid line 4 connected to a tank 6 on the surface (not shown). An electrolyte, typically sea water, is injected into the well bore via the first fluid line 4.

In FIG. 2 the cathode which is connected to the negative pole of the power source, is formed by the exterior surface of the first fluid line 4. In this embodiment the exterior surface of the first fluid line 4 is partially electrically conducting and partially insulating. Thus in the interval 20 where iron-containing, e.g. steel, casing is to be removed, the exterior surface of the first fluid line is electrically conducting whereas in the areas 21, 22 where the iron-containing casing is to remain the exterior surface of the first fluid line 4 is non-electrically conducting, e.g. coated with an insulating material. Advantageously this means that neither plugs nor a dual coil fluid line is required. Instead the electrolyte can be pumped out of the well bore via the well bore.

FIGS. 1 and 2 illustrate how the systems and methods of the present invention allow for selective electrochemical removal of iron-containing casing from a well bore. In the embodiments shown in FIG. 1 selectivity is achieved by using plugs. In this case the iron is removed in the interval in between the plugs. In the embodiment shown in FIG. 2 selectivity is achieved by the placement of the cathode, e.g. by making the exterior surface of the fluid line partially electrically conducting (i.e. cathodic) and partially insulating. In this case iron is removed in the interval where the exterior surface of the first fluid line is electrically conducting, i.e. cathodic.

In the methods and systems of the present invention the solution (i.e. electrolyte) is preferably removed from the well bore and ultimately reinjected therein. Preferably the solution is treated to remove iron ions (e.g. iron compounds) and/or hydrogen prior to reinjection into the well bore as shown in FIG. 3.

Figure 3:
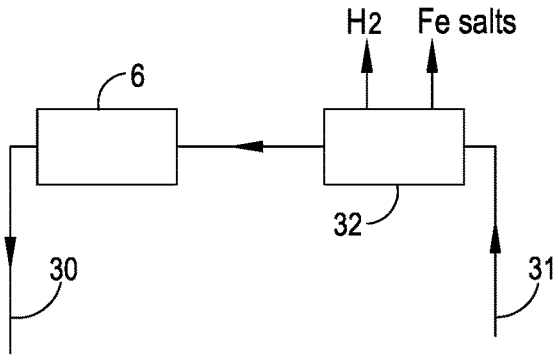
FIG. 3 is a flow diagram of a preferred system of the present invention.

FIG. 3 shows a system and method for recirculating the solution. Arrow 30 shows the solution, i.e. electrolyte, being pumped into the well bore (not shown) in a first fluid line 4. In the well bore the solution accelerates the oxidation of iron to iron cations. This reaction produces iron ions which dissolve and hydrogen as described above. Arrow 31 shows the solution being pumped out of the wellbore via fluid line 5 or via the well bore itself. This solution is fed into a separation unit 32 which comprises a gas/liquid separator to faciliate removal of hydrogen gas. The hydrogen gas is collected, and preferably measured, and sent for flare. The separation unit 32 also comprises a means to remove iron ions from the solution. After removal of $H_2$ and iron ions the solution is fed to a tank 6 from where it is injected back into the well bore.

EXAMPLES

Steel Tubes for Laboratory Testing

Pipes in alloy A106 grade B, in two dimensions as set out below, were used for testing:

¾" schedule pipe: 26.7 mm OD, 21.0 mm ID

3" schedule pipe: 88.9 mmm OD, 77.9 mm ID

The chemical compositions of the two different carbon steels are shown in Table 1 below.

These alloys are similar to the steel typically used in well bore casing.

TABLE 1

| | Alloy | | | | | | | |
|---|---|---|---|---|---|---|---|---|
| | % Cr | % Mo | % C | % Mn | % S | % Si | % P | % Cu |
| AISI4140 | 0.80-1.1 | 0.15-0.25 | 0.38-0.43 | 0.75-1.0 | 0.040 | 0.15-0.35 | 0.035 | |
| A106 gr. B | 0.4 | 0.15 | 0.30 | 0.29-1.26 | 0.035 | 0.10 | 0.035 | 0.40 |

Flowing velocity and volume/area ratio for laboratory testing

By assuming equal mass transfer coefficients the relation between flow rates for pipes of two different diameters can be simplified as follows:

$$\frac{v_2}{v_1} = \left(\frac{D_2}{D_1}\right)^{0.25}$$

In the lab-tests the volume/weight ratio should ideally correspond to the ratio between the volume of solution/electrolyte and the amount of steel to be removed in actual use in a well bore. A volume/area ratio of 1.47 $m^3/m^2$ was calculated assuming that the solution/electrolyte is kept in 100 $m^3$ tanks and the internal surface area of 100 m of the casing 9⅗"×8½" to be removed is 68 $m^2$. For practical reasons, however, the testing had to be performed at lower volume/area ratios. For chemical and electrochemical dissolution tests the ratios used were 0.51, and 0.17 or 0.33 $m^3/m^2$, respectively.

Electrochemical Casing Removal

Experimental

Figure 4:
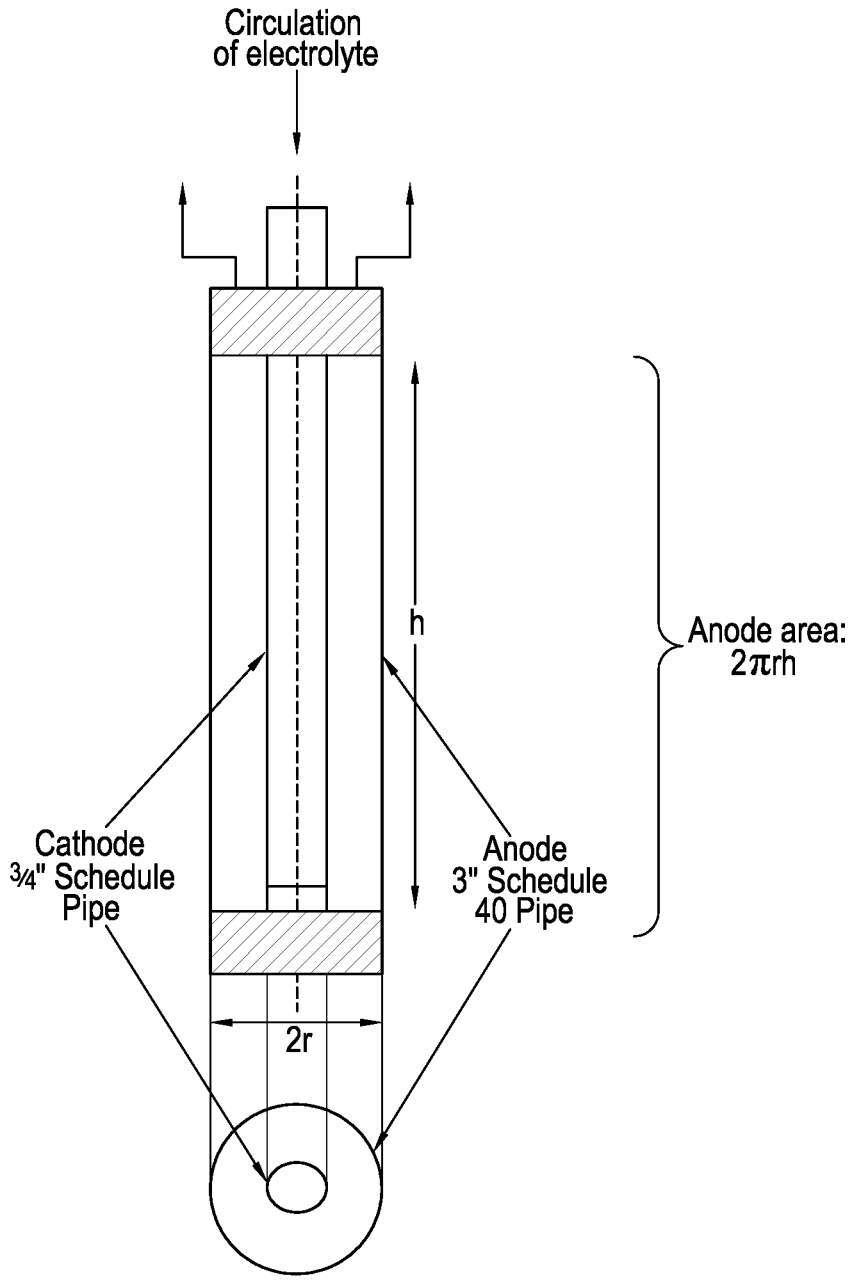
FIG. 4 is a schematic of a test cell for electrochemical dissolution testing

The test cell used is shown in FIG. 4. Samples cut from 3" schedule pipe was used to mimic "casing". When applying a DC voltage/current, the inner surface dissolved anodically. Outer surface of a ¾" steel pipe centered inside the 3" pipe acted as cathode. The inner pipe is also used to control the electrolyte flowing through the test cell. The dimensions of the pipe acting as cathode in lab tests were selected in order to get the same "anode/cathode ratio" as would be obtained in service. A casing tube 9⅝" in size and a 2⅞" CT pipe acting as cathode is assumed for the well.

Introductory Testing

Electrolytes used were 3.5 weight % NaCl containing either HCl or $H_2SO_4$, and the test temperature was 60° C. (except in one test performed at ambient room temperature). In the HCl acidified electrolyte the pH was usually between 2 and 3.5 when starting the dissolution test (except test 3 performed at pH 8-9). When the dissolution test was ended a pH between 7 and 9 was generally measured. Due to the high acid content, the NaCl electrolyte containing 20 weight % $H_2SO_4$ was acidic also after ending the electrochemical dissolution tests.

Second Series of Tests

The test matrix carried out is shown in Table 2.

TABLE 2

Test matrix for electrochemical dissolution of steel

| Testing environment | Electrolyte density [g/cm³] | Current density [A/m²] 700 | 860 | 900 | Exposure time [hours] 6 (7) | 20 (24) | Flowing rate [m/s] 0.1 |
|---|---|---|---|---|---|---|---|
| 20 wt % NaCl | 1.11 | x | | | x | x | x |
| 3.5 wt % NaCl + | 1.19 | x | | x | | x | x |

TABLE 2-continued

Test matrix for electrochemical dissolution of steel

| Testing environment | Electrolyte density [g/cm³] | Current density [A/m²] 700 | 860 | 900 | Exposure time [hours] 6 (7) | 20 (24) | Flowing rate [m/s] 0.1 |
|---|---|---|---|---|---|---|---|
| 20% $H_2SO_4$ | | x | x | | x | | x |
| 20 wt % NaCL + 20% $H_2SO_4$ | 1.28 | | | x | | x | x |

Additionally two tests combining chemical and electrochemical dissolution were carried out as shown in Table 3.

TABLE 3

Test matrix for cyclic testing of combined chemical and electrochemical dissolution of steel in 20% wt NaCl + 20% vol $H_2SO_4$ at 60° C. and 0.1 m/s flowing rate

| Testing conditions 20% NaCl + 20% $H_2SO_4$ | Cyclic testing - Current on/off: Current density [A/m²] | Time [min] | Number of cycles |
|---|---|---|---|
| 6.5 hours test, 3 cycles | 900 | 55 | 3 |
| | 0 | 55 | 2 |
| | 0 | 117 | 1 |
| One day test, 13 cycles | 900 | 55 | 13 |
| | 0 | 55 | 13 |

Results of the Introductory Testing

The results of the preliminary electrochemical dissolution testing are shown in FIG. 5.

FIG. 5: Preliminary electrochemical dissolution testing in different test solutions at 60° C. and 0.1 m/s Testing was performed by increasing the current densities from approximately 100 to 700 A/$m^2$. Visual investigation of the steel tube after testing indicated uniform dissolution of the "casing" tube. Gravimetrically determined dissolution rates of the steel tube indicated current efficiencies at about 100% in the major part of the electrochemical tests. Test 1 performed at ambient room temperature and an applied current of 12.9 A (or current density of 108 A/$m^2$) showed lower current efficiency (82%). A protective oxide scale at the inner surface of the as received steel tube and the short test period (1.5 hours) may explain the low current efficiency in the test. The same steel tube was used as anode in the remaining tests.

Theoretical dissolution rate for Fe to $Fe^{2+}$ is calculated from current applied as follows:

$$n_{Fe} = \frac{I \cdot t}{F} = n_{H_2}$$

Current efficiency is calculated as the percentual relation between experimental and theoretical dissolution of the carbon steel tube. In some tests current efficiencies above 100% are determined. The latter may be due to some variations in the applied current during testing. The electrolyte temperature showed generally no or only a minor increase during the electrochemical tests. The applied current (i.e. current density) is the determining factor for the electrochemical dissolution rate. Variations in electrolyte composition had no significant effect on the dissolution rate of the steel tube. When applying a current density of 700 $A/m^2$, the obtained results indicate that 100 m of a casing tube 9⅝"×8½ in dimension can be dissolved within 6 days.

Results of the Second Series Tests

The results of electrochemical dissolution testing in 20 wt % NaCl and 20 wt % NaCl+20% $H_2SO_4$ are shown in FIG. 6.

FIG. 6: Electrochemical dissolution in 20 wt % NaCl and 20 wt % NaCl+20% $H_2SO_4$ at 60° C. and 0.1 m/s Testing was performed by applying DC current densities in the range 700-900 $A/m^2$. As in the introductory tests current efficiencies of approximately 100% were determined indicating that the applied current density is generally determining the dissolution rate of carbon steel. In one of the tests a current efficiency of 89% was determined. This test was performed in 3.5 wt % NaCl+20% $H_2SO_4$ with a high content of Fe (115 g/l). Visual evaluation also showed a high number of precipitates in this test solution. The latter may indicate a certain passivation of the steel pipe. Except for this test, variations in electrolyte composition had no significant effect on the dissolution rate of the steel tube. When applying a current density of 900 $A/m^2$, the results indicate that 100 m of a casing tube 9⅝"×8½" in dimensions can be dissolved within 5 days.

By assuming that conditions for electrochemical dissolution in service are the same as the test conditions used here hydrogen production in lab and service have been estimated, as shown in Table 4. The gas volumes are determined assuming that the ideal gas law is valid. Thus, the reported dissolution rates indicate production of $H_2$(g) at up to 620 $m^3$/day@25 C, 1 bara.

Results of combined electrochemical and chemical dissolution testing

The results of combined electrochemical and chemical dissolution are summarized in FIG. 7.

FIG. 7: Combined electrochemical and chemical dissolution in 20 wt % NaCl+20% $H_2SO_4$ at 60° C. and 0.1 m/s The dissolution rate determined from weight loss measurements indicated that the obtained weight loss can be explained mainly by the electrochemical process.

SUMMARY

Electrochemical dissolution rates depend mainly on current densities applied. Generally, 100% current efficiency is determined for electrochemical tests performed. Based on determined steel dissolution rates a 9⅝"×8½" casing can be removed within approximately 5 days when applying a current density of 900 $A/m^2$.

The invention claimed is:

1. A method for removing iron-containing casing from a well bore comprising:

(i) providing a cathode in said well bore, wherein the exterior surface of a fluid line forms said cathode, and said cathode is connected to the negative pole of a power source;

(ii) connecting said iron-containing casing to the positive pole of said power source;

(iii) injecting an electrolyte into said well bore, wherein said electrolyte contacts said iron-containing casing and said cathode;

(iv) applying a current so that the iron in said iron-containing casing is oxidized to iron cations;

(v) allowing said iron cations to dissolve in said electrolyte;

(vi) removing said electrolyte from said well bore;

(vii) separating said iron cations and hydrogen from said electrolyte.

2. A method as claimed in claim 1, which removes said iron-containing casing from a selected interval of said well bore.

TABLE 4

Amount of $H_2$ (g) produced by electrochemical casing removal

| | | | | Production of $H_2$ | | |
|---|---|---|---|---|---|---|
| | | | | Lab test Moles | 100 m section of casing 9⅝" × 8½" | |
| Electrochemical testing, 500 mm casing tube | Time [d] | Current density [$A/m^2$] | Dissolution of Fe [g] | per area and day mol/$m^2$, day | Moles on 68 $m^2$ of the casing mol/day | Volume assuming ideal gas $m^3$/d |
| 20 wt % NaCl (no acid) | 1.00 | 70 | 1051 | 313 | 21308 | 479 |
| 20 wt % NaCl (no acid) | 0.25 | 700 | 256 | 305 | 20761 | 466 |
| 20 wt % NaCl + 20% $H_2SO_4$ | 0.29 | 700 | 305 | 312 | 21201 | 476 |
| 20 wt % NaCl + 20% $H_2SO_4$ | 0.25 | 858 | 325 | 388 | 26357 | 592 |
| 20 wt % NaCl + 20% $H_2SO_4$ | 1.00 | 900 | 1357 | 405 | 27512 | 618 |
| 3.5 wt % NaCl + 20% $H_2SO_4$ | 1.00 | 902 | 1352 | 403 | 27411 | 616 |
| 3.5 wt % NaCl + 20% $H_2SO_4$ | 1.03 | 700 | 955 | 277 | 18864 | 424 |

3. A method as claimed in claim 1, wherein said well bore is temporarily plugged above and temporarily or permanently plugged below said selected interval of said well bore.

4. A method as claimed in claim 3, wherein said electrolyte is delivered into, and removed from, said well bore via a dual fluid line.

5. A method as claimed in claim 1, wherein the exterior surface of the fluid line is partially electrically conducting and partially insulated.

6. A method as claimed in claim 5, wherein said electrolyte is delivered into said well bore via the fluid line and removed via the well bore.

7. A method as claimed in claim 1, wherein the electrical current density applied is 50 to 2000 ampere/$m^2$ casing surface.

8. A method as claimed in claim 1, wherein the cell voltage/potential is 1 to 10 V.

9. A method as claimed in claim 1, wherein the power supplied is 10 to 500 kW per 100 m length of casing.

10. A method as claimed in claim 1, wherein said electrolyte has a superficial linear velocity of 2 to 50 cm/s in said well bore.

11. A method as claimed in claim 1, wherein said electrolyte comprises at least 2% wt salt.

12. A method as claimed in claim 1, further comprising reinjecting said electrolyte removed from said well bore into said well bore.

13. A method as claimed in claim 1, wherein said electrolyte further comprises an iron cation stabilising stabilizing compound.

14. A method as claimed in claim 12, wherein the volume of electrolyte circulating is 20 to 200 $m^3$.

15. A method as claimed in claim 1, further comprising the steps of:

(i) removing dissolved iron ions from said electrolyte removed from said well bore;

(ii) removing hydrogen from said electrolyte removed from said well bore; and (iii) reinjecting said electrolyte into said well bore.

16. A method as claimed in claim 1, wherein said method is continuous.

17. A method as claimed in claim 1, wherein said iron-containing casing comprises steel.

18. A method as claimed in claim 1, wherein said selected interval of well bore is 10 to 200 m in length.

19. A method as claimed in claim 1, wherein in said well bore the temperature is 30 to 200° C.

20. A method as claimed in claim 1, wherein in said well bore the pressure is 200 to 700 bar.

21. A method for monitoring the removal of an iron-containing casing from a well bore comprising:

(i) carrying out an electrochemical method for removing iron-containing casing from a well bore as claimed in claim 1 wherein $H_2$ gas is liberated in the process;

(ii) determining the amount of hydrogen liberated in the process; and (iii) determining the amount of iron-containing casing dissolved.

22. A method of plugging and abandoning a well comprising;

(i) carrying out a method as claimed in claim 1 to remove iron-containing casing from the well bore; and (ii) sealing said well by forming a plug across its cross-section with cement.

23. A method as claimed in claim 22, wherein said well is a hydrocarbon well.

24. A system for removing iron-containing casing from a well bore comprising:

(i) a well bore comprising a cathode connected to the negative pole of a power source and an iron-containing casing connected to the positive pole of the power source;

(ii) a power source;

(iii) a first fluid line for injecting an electrolyte into said well bore;

(iv) a means for removing electrolyte from said well bore;

(v) a tank comprising said electrolyte; wherein said tank is fluidly connected to said first fluid line and wherein said cathode is the exterior surface of said first fluid line;

(vi) a separation system for separating iron ions and hydrogen from said electrolyte, wherein said means for removing electrolyte is fluidly connected to said separation system; and said separation system is fluidly connected to said tank.

25. A system as claimed in claim 24, wherein the exterior surface of said first fluid line is partially electrically conducting and partially insulated.

26. A system as claimed in claim 24, wherein said means for removing electrolyte is the well bore.

27. A system as claimed in claim 24, further comprising a second fluid line.

28. A system as claimed in claim 27, wherein said first and second fluid lines are present in a dual fluid line.

29. A system as claimed in claim 27, wherein said well bore comprises temporary plugs above and temporary or permanent plugs below the interval from which the iron-containing casing is to be removed.

30. A system as claimed in claim 24, wherein said tank and said separation system are located on a floating vessel.

31. A system as claimed in claim 24, wherein said separation system comprises a means for monitoring the amount of hydrogen removed from said electrolyte.

* * * * *